US005996388A

United States Patent [19]

Mantovan et al.

[11] Patent Number: 5,996,388

[45] Date of Patent: Dec. 7, 1999

[54] HYDRAULICALLY PRELOADED ROLLING STANDS

[75] Inventors: Gianfranco Mantovan, Busto Arsizio; Bruno Monzio Compagnoni, Olgiate Olona; Rodolfo Tapparo, Malnate, all of Italy

[73] Assignee: Techint Compagnia Tecnica Internazionale S.p.A., Milan, Italy

[21] Appl. No.: 09/162,448

[22] Filed: Sep. 29, 1998

[30] Foreign Application Priority Data

Oct. 1, 1997 [IT] Italy ..... MI97A2221

[51] Int. Cl.[6] ..... B21B 31/07; B21B 31/32

[52] U.S. Cl. ..... 72/245

[58] Field of Search ..... 72/237, 240, 244, 72/245, 248, 243.2, 243.4, 241.4

[56] References Cited

U.S. PATENT DOCUMENTS 3,948,072 4/1976 Aramaki ..... 72/245

5,596,899 1/1997 Sendzimir et al. ..... 72/245

*Primary Examiner*—Rodney Butler

*Attorney, Agent, or Firm*—Oblon, Spivak, McClelland, Maier & Neustadt, P.C.

[57] ABSTRACT

A rolling cage to produce hot rolled bars, comprising at least one pair of rolling cylinders (12, 13) mounted on their respective stands (14, 15) in which a clearance (17) (processing gap) between said cylinders (12, 13) is adjusted by a system of screws (18) and lead screws (21), and which provides for a hydraulic pre-loading system of the same cylinders (12, 13) after adjusting the said clearance (17). According to the invention, the pre-loading system of said hydraulic cylinders (12, 13) comprises a multiple number of rods (27) crossing said stands (14, 15) and capable of a relative sliding motion. Each of said rods (27) is at one extremity (28) attached to a stand (14) while the opposite extremity is equipped with a piston (29) moving inside a hydraulic cylinder (30) firmly attached to the stand (15) opposite the former, so that said rods (27) also serve the function of opposing the rolling torque.

4 Claims, 5 Drawing Sheets

18
28
14
26
21
23
19
33
12
25
27
11

HYDRAULICALLY PRELOADED ROLLING STANDS

This invention refers to a few interesting and advantageous improvements made to hydraulically preloaded rolling cages, in particular for producing hot rolled bars of a given size and very narrow dimensional tolerances.

The rolling and calibrating cages for producing hot rolled products are for instance described and illustrated in the patents EP-166478 and EP-626218, to be referred to for further clarifications.

As it is well known to the skilled in the art, certain serious problems may arise in the course of the rolling process, due to the jamming of the rolled product between the rolling cylinders.

This makes it necessary to shut down the rolling line and open the cylinders of the affected cage as quickly as possible. The purpose is to remove the product jammed between the rolling cylinders, which must subsequently be re-closed, again as quickly as possible and using the same adjustment (rolling gap) as before, so as to produce hot rolled bars of a given size and very narrow dimensional tolerances.

In rolling and calibrating cages of a known type, equipped with hydraulic cylinder pre-loading devices, the opening of the latter in case of jamming—after deactivating the pre-loading condition—is done by acting on the same screw and lead-screw type adjusting systems, by which the working conditions have initially been set.

The opening of the rolling cylinders by the screw and lead-screw type adjusting systems in order to remove the product jammed between the same, and the subsequent re-closing, requires long periods of time and the loss of the initial working condition, which must again be re-established with all the problems, including a loss of precision, resulting from the action.

The main scope of this invention is therefore to eliminate the drawbacks of the prior art, by producing a hydraulically pre-loaded rolling cage equipped with a rapid opening system for the rolling cylinders, so as to avoid affecting the original cylinder adjustment (gap), whose value, at the re-closing of the mentioned cylinders (after removing the jamming), is the same as at the original setting.

Another problem of the known cages derives from the numerous free plays in the screw and lead-screw type system used to adjust the clearance (gap) between the rolling cylinders.

These free plays are also a source of excessive dimensional tolerances in the finished product.

Another scope of the invention is therefore to produce a rolling and calibrating cage designed to eliminate the mentioned free plays.

The mentioned scopes are achieved by a rolling cage endowed with the characteristics outlined in the attached claims.

The structural and functional characteristics of the invention and its advantages with respect to the known art can be more clearly understood by reviewing the following description, referred to the accompanying drawings, which offers an example of a practical embodiment of this invention. In the drawings.

Figure 1:
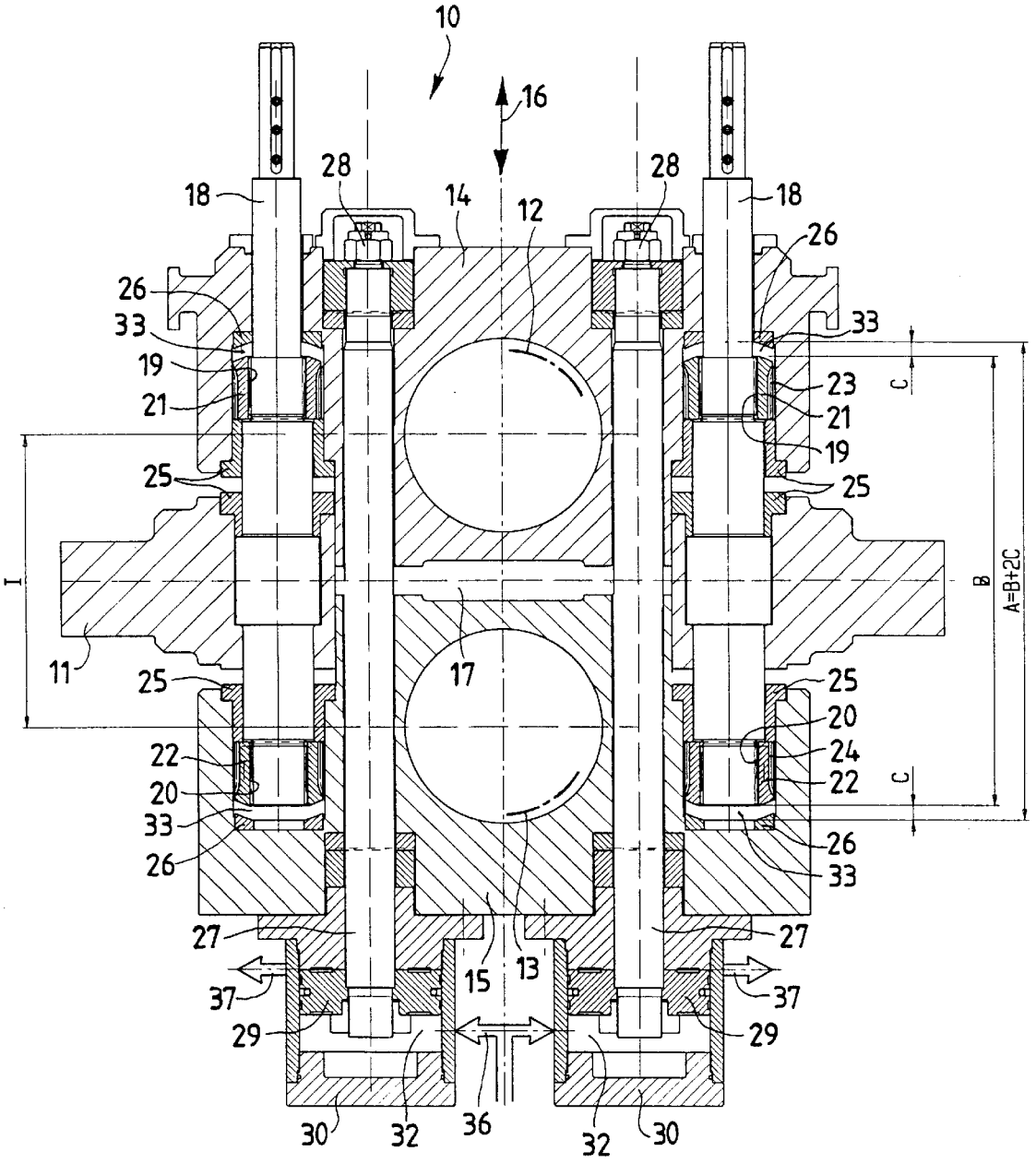
FIG. 1 is a vertical cross-section illustrating a rolling and calibrating cage built according to the invention, with the rolling cylinders in an open position.

With reference to the figures, the rolling and calibrating cage according to the invention indicated by the number 10 is structurally composed of a rigid supporting frame 11 mounting a pair of rolling cylinders 12, 13, known as upper and lower cylinder, respectively.

Said cylinders 12, 13 are supported by their respective stands 14, 15 which can be controlled to approach or spread apart from each other in the direction of the arrow 16, so as to adjust the clearance 17 between the same cylinders 12, 13 (processing gap).

According to this invention, the motion of the stands 14, 15 in the direction of the arrow 16 is controlled by the combination of a first screw and lead-screw type system, and a second system based on hydraulically operated rods.

The cage illustrated in the drawings, merely for exemplifying and non-limiting purposes, is a so-called dual cage (meaning composed of a single pair of rolling cylinders), and comprises, in such a screw and lead-screw type system for adjusting the gap 17, four shafts 18 which can be actuated to rotate on bronze bushings 25, each equipped with two threaded sections 19, 20 known as upper and lower section, respectively. The threaded portions of these sections are discordant, meaning that 19 has for example a right-hand and 20 a left-hand thread.

These threaded sections 19, 20 rotate on respective lead screws 21, 22 keyed in 23, 24 on the stands 14, 15 Inside seats 33. Said lead screws 21, 22 can consequently be shifted axially in the direction of the arrow 16, but are blocked against rotating.

The number 26 indicates the spherical spacers housed in said seats 33 and cooperating with the lead screws 21, 22, whose free terminal edge is contoured accordingly. On the contrary, the hydraulic rod system, which as later explained cooperates with the screw and lead-screw type system, comprises four rods 27 which cross the stands 14, 15, while being capable of shifting with respect to the same. As clearly shown in the drawings, the rods are arranged adjacent to the shafts 18 of the screw and lead-screw type system.

Each of the said rods 27 is at one extremity firmly attached in 28 to an upper stand 14, while the opposite extremity is fitted with a piston 29 moving inside a hydraulic cylinder 30 attached to the lower stand 15. The operation of the cage according to the invention is as follows.

Figure 2:
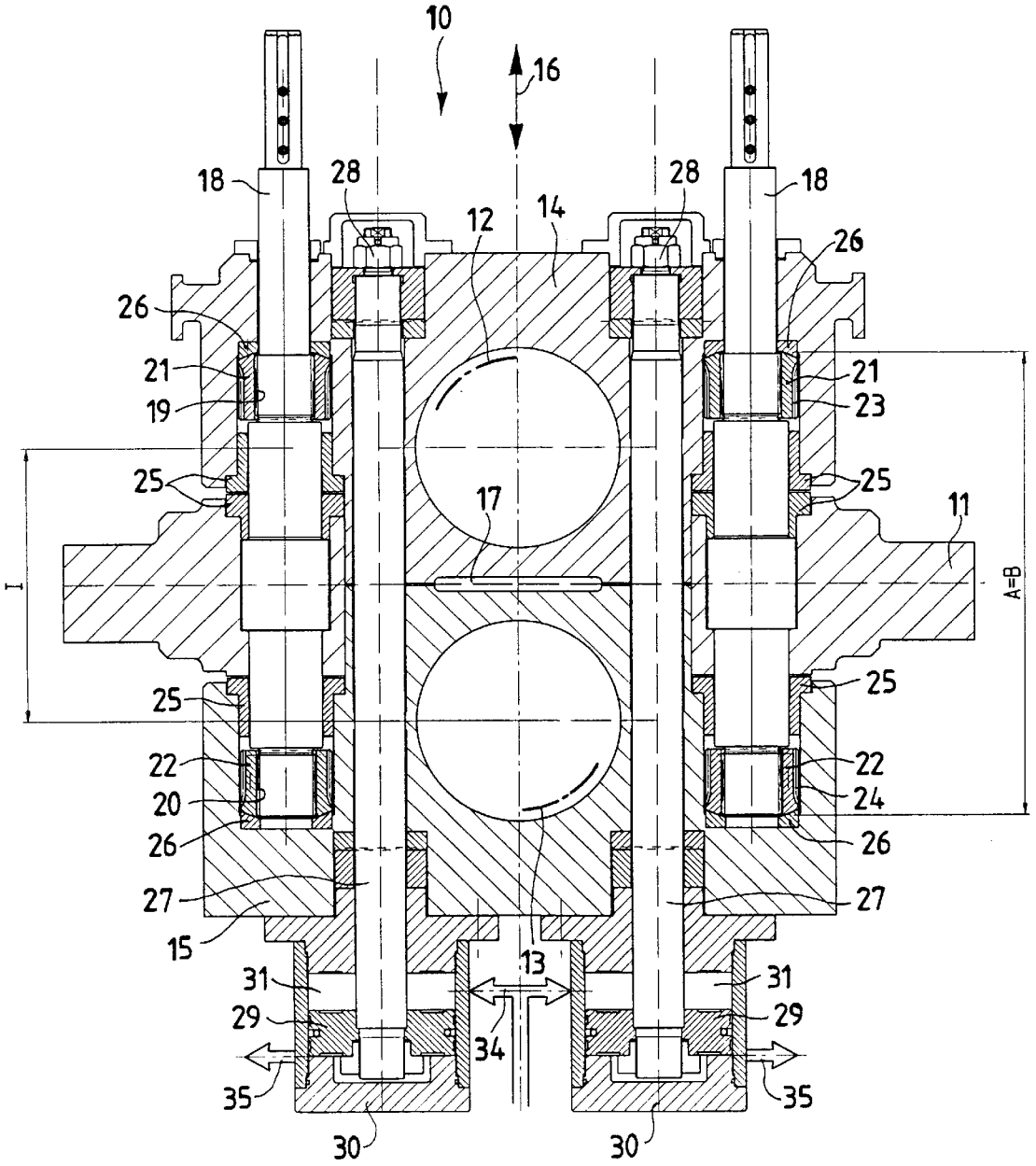
FIG. 2 is a vertical cross-section illustrating the same cage of FIG. 1, but with the rolling cylinders in a closed position.
Figure 3:
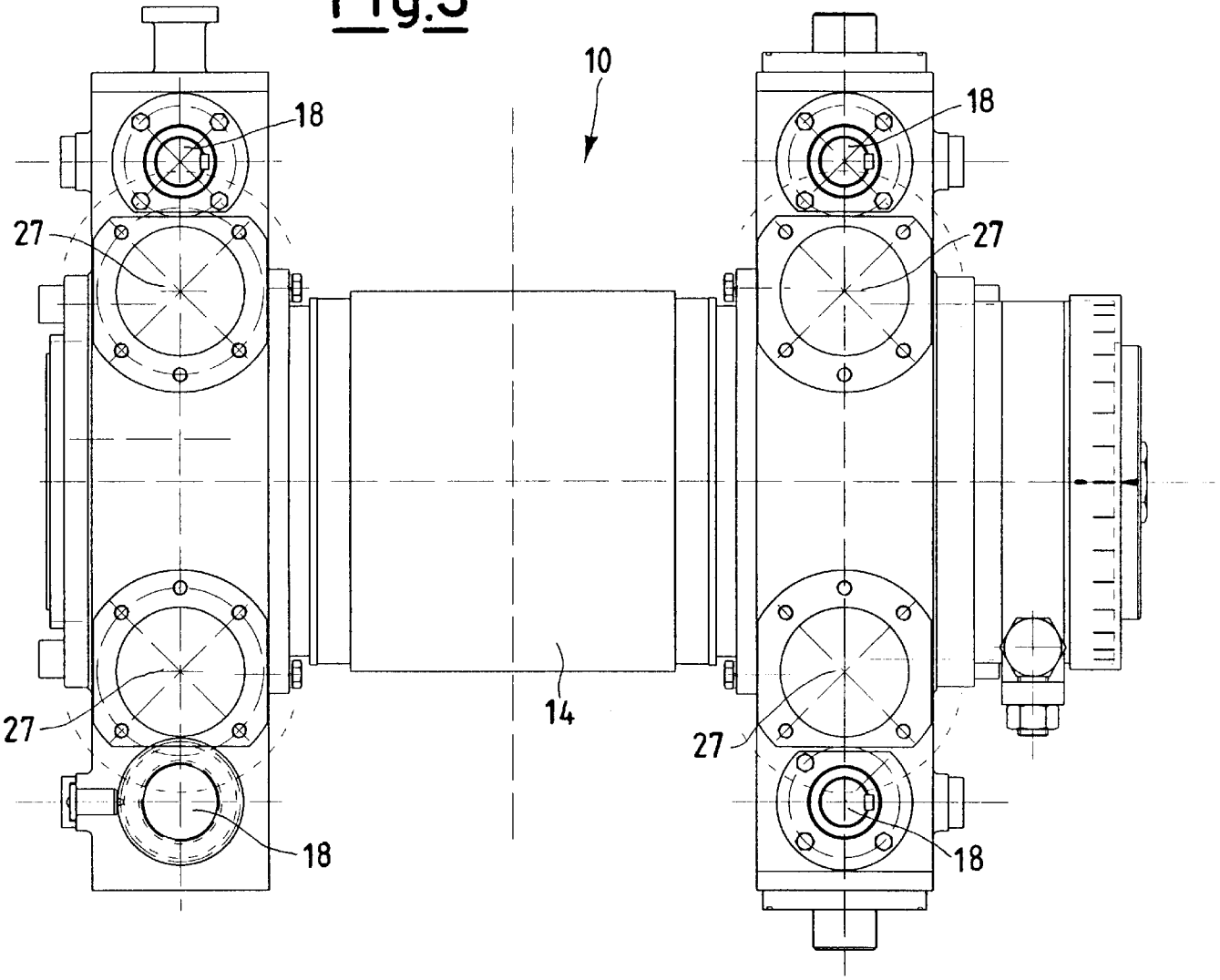
FIG. 3 is a plan view of the cage shown in FIGS. 1 and 2.
Figure 4:
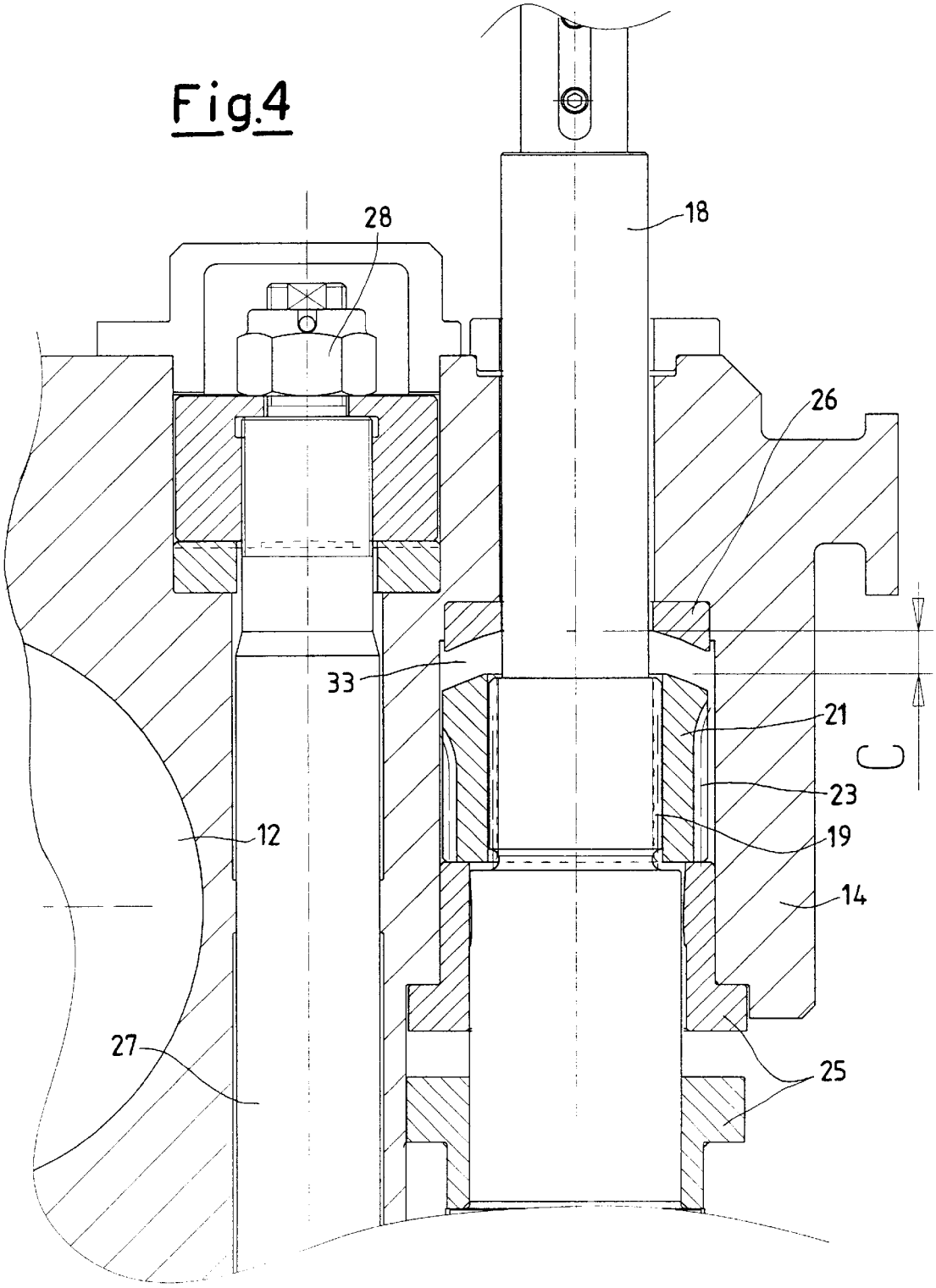
FIG. 4 is a cross-sectional view of an enlarged detail illustrating the position of the adjusting system for the clearance between the cylinders (processing gap), in the same position of FIG. 1.
Figure 5:
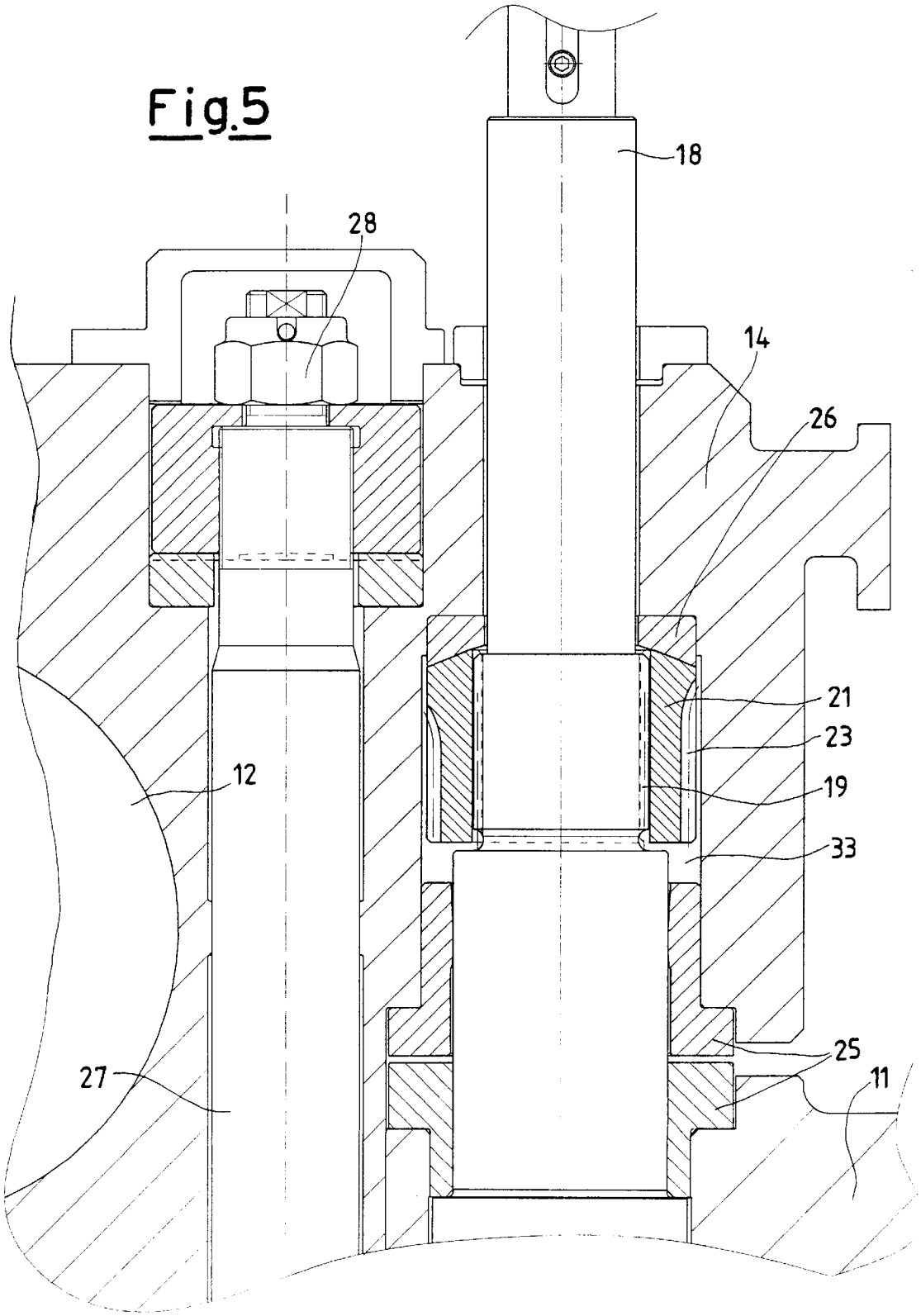
FIG. 5 is a view as in FIG. 4, but showing the system for adjusting the clearance between the cylinders (processing gap) in the same position of FIG. 2.

In order to move the rolling cylinders 12, 13 from an opened non-operating position shown in FIG. 1 to a closed operating position as shown in FIG. 2, a first action is taken on the screw and lead-screw adjusting system by rotating the shafts 18 causing the lead-screws 21, 22 to shift in discordant directions and thereby approach the stands 14, 15 until they reach the desired position, meaning the clearance 17 (processing gap) provided between the cylinders 12, 13 in question. Action is then taken on the hydraulic rod system 27, by injecting pressurized fluid into the chamber 31 of the cylinder 30, which causes a pre-loading of the cage in the position previously adjusted by the screw and lead-screw type system, thus totally eliminating any free plays.

In a simplified manner, the arrows 34 in FIG. 2 show the pressurized oil feedlines to the chambers 31, while the arrows 35 indicates the discharges of the opposing chambers 32.

Should it become necessary in the course of the rolling process to open the cylinders 12, 13, for example in a case of jamming, it will suffice to act on the hydraulic rod system 27, by injecting pressurized oil into the chamber 32 of the cylinder 30. This will cause the stands 14, 15 and consequently the cylinders 12, 13 to rapidly spread apart, without taking any action on the screw and lead-screw type system, so that the value of the previously adjusted clearance 17 remains memorized.

In a simplified form, the arrows 36 in FIG. 1 indicate the pressurized oil feedlines to the chambers 32, while the arrows 37 indicate the discharges of the opposite chambers 31.

After eliminating the jamming by acting on the rod-type system, meaning by injecting pressurized oil into the chamber 31, the cage can quickly be returned to the closed working position shown in FIG. 2, at the same originally adjusted clearance 17.

This achieves the scopes mentioned in the first part of the description, designed to produce a hydraulically pre-loaded rolling and calibrating cage practically devoid of any free plays on the adjusting screws, and endowed with the possibility of effecting a rapid opening motion of the rolling cylinders in the case of jamming, followed by a closing in exactly the same position as before, meaning with the same clearance between the cylinders (processing gap) set up at the start of the rolling process, without any need to take further action on the screw and lead-screw adjusting systems.

From the description given above, it will also be evident to the skilled in the art that the rolling torque does not discharge on the shafts 18 of the screw and lead-screw system, but on the rods 27, so that the shafts 18 are merely left with the task of supporting the stands 14, 15 in their pre-established positions.

The scope of the invention is defined by the following claims.

What is claimed is:

1. A rolling cage comprising:

an upper stand;

a lower stand;

at least one upper rolling cylinder mounted in the upper stand;

at least one lower rolling cylinder mounted in the lower stand;

a system of screws and lead screws for adjusting a gap between the upper rolling cylinder and the lower rolling cylinder;

a hydraulic pre-loading system for applying a pre-load on said cylinders after the gap is adjusted comprising a plurality of rods crossing the upper stand and the lower stand while providing a relative sliding motion between the stands and the rods wherein one extremity of each of said rods is firmly attached to one of said stands while the opposite extremity carries a piston arranged in a mobile manner inside a hydraulic cylinder attached to the other of said stands so that the rods also serve the function of opposing the rolling torque;

said system of screws and lead screws comprising a multiple number of rotatable shafts fitted with first and second discordantly threaded portions, the first threaded portion being connected by a first lead screw to one of said stands, the second threaded portion being connected by a second lead screw to the other of said stands, a first key connecting the first lead screw to said one of said stands to prevent rotation of the first lead screw but permitting limited axial sliding movement of the first lead screw with respect thereto, a second key connecting the second lead screw to said other of said stands to prevent rotation of the second lead screw but permitting limited axial sliding motion of the second lead screw with respect thereto, whereby the system of screws and lead screws sets the gap between the upper rolling cylinder and the lower rolling cylinder but allow the gap to be enlarged due to the limited axial sliding motion of the first and second lead screws upon actuation of the hydraulic pre-loading system in a direction to relieve the pre-load on said cylinders.

2. A rolling cage according to claim 1, wherein said hydraulic pre-load system comprises four rods.

3. A rolling cage according to claim 1, wherein each of said rods is attached to the upper stand while said hydraulic cylinder is attached to the lower stand.

4. A rolling cage according to claim 1, wherein said system of screws and lead screws comprises four shafts arranged adjacent to said rods.

* * * * *